US006619298B2

(12) United States Patent
Gueret

(10) Patent No.: US 6,619,298 B2
(45) **Date of Patent: *Sep. 16, 2003**

(54) DEVICE FOR MAKING UP THE LIPS

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/058,867

(22) Filed: Jan. 30, 2002

(65) Prior Publication Data

US 2002/0069892 A1 Jun. 13, 2002

Related U.S. Application Data

(63) Continuation of application No. 09/565,544, filed on May 5, 2000, now Pat. No. 6,343,608, which is a continuation of application No. 08/908,442, filed on Aug. 7, 1997, now Pat. No. 6,076,534.

(30) Foreign Application Priority Data

Aug. 8, 1996 (FR) ..... 96-10018

(51) Int. Cl.[7] ..... A45D 40/26
(52) U.S. Cl. ..... 132/320; 132/320; 132/317
(58) Field of Search ..... 132/320, 317, 132/318, 297, 293; 401/126, 60

(56) References Cited

U.S. PATENT DOCUMENTS

| | | | |
|---|---|---|---|
| 1,782,911 A | 11/1930 | Scrimgeour | |
| 2,606,565 A | 8/1952 | Sage, Sr. | |
| 2,735,435 A | 2/1956 | Feinstein | |
| 3,308,837 A | 3/1967 | Selleck | |
| 3,431,919 A | 3/1969 | van der Bosch | |
| 3,863,654 A | 2/1975 | Morane et al. | |
| 4,372,331 A | 2/1983 | Thompson | |
| 4,611,611 A | 9/1986 | Beal, Jr. | |
| 4,617,948 A | 10/1986 | Gueret | |
| 4,627,454 A | 12/1986 | Dahm | |
| 4,699,780 A | 10/1987 | Jennings et al. | |
| 4,796,647 A | 1/1989 | Gueret | |
| 5,020,553 A | 6/1991 | De La Rocha | |
| 5,492,426 A | 2/1996 | Gueret | |
| 6,343,608 B1 * | 2/2002 | Gueret | 132/320 |

FOREIGN PATENT DOCUMENTS

| | | |
|---|---|---|
| FR | 677665 | 3/1930 |
| FR | 752860 | 9/1933 |
| FR | 1420452 | 2/1966 |
| FR | 2259560 | 8/1975 |
| GB | 2026857 | 1/1980 |
| JP | 60149314 | 10/1985 |
| JP | 43-21689 | 11/1992 |

* cited by examiner

*Primary Examiner*—John J. Wilson
*Assistant Examiner*—Robyn Kieu Doan
(74) *Attorney, Agent, or Firm*—Finnegan, Henderson, Farabow, Garrett & Dunner, LLP

(57) ABSTRACT

A device (1) for making up, or for a care treatment, of the user's lips (L) includes a support (2) at least a portion of which can be impregnated by a pulverulent or liquid-to-pasty product (P). The support (2) has a flattened shape and has at least one application surface (4, 6) capable of coming into contact with at least one of the user's lips, the portion impregnated with the product being capable of elastic deformation by compression of the surfaces by the lips and of assuming their shape, so that a transfer of the product to the lips is effected during the compression of the support between the user's lips.

22 Claims, 2 Drawing Sheets

DEVICE FOR MAKING UP THE LIPS

This application is a continuation of U.S. application Ser. No. 09/565,544, filed May 5, 2000 now U.S. Pat. No. 6,343,604, which is a continuation of U.S. application Ser. No. 08/908,442, filed Aug. 7, 1997, now U.S. Pat. No. 6,076,534, both of which are hereby incorporated by reference.

BACKGROUND OF THE INVENTION

1. Field of the Invention

The present invention relates to a device for making up the lips or for the care of a user's lips, more particularly for a simultaneous treatment of both lips.

2. Description of the Related Art

Generally, such a treatment of the lips is performed either by means of a stick of solid and friable lip rouge which the user spreads over her lips, or by means of a brush-type applicator when the make-up composition is a fluid. In both these cases it is necessary to apply the product with care, using a mirror, in order to obtain a careful and precise make up. It is, moreover, necessary to renew this make up several times per day, since the hold of the product on the lips is limited in the course of time, particularly after a meal.

The operation of treating the lips by means of a stick or brush of lip rouge is delicate, in particular when the user wishes to renew her make up during the day, for example in the office or during transit in a car or subway, or when a care product has to be applied to the lips, for example during winter sports or at the beach.

SUMMARY OF THE INVENTION

To avoid the above mentioned drawbacks, it is an object of the invention to provide a convenient make-up device allowing the lips to be made up without the need for a mirror.

It is a further object of the invention to provide a make-up device which allows the user to make up one or preferably both lips simultaneously in a short time and in a precise manner.

It is yet a further object of the invention to provide a make-up device which is advantageous from an economic standpoint since it does not have a complicated mechanism and does not require costly assembly, and so can be offered to the user at a low price.

The above and other objects are achieved according to the invention by a device for the make up or care treatment of the user's lips, comprising a support, at least a portion of which can be impregnated by a pulverulent or liquid-to-pasty product. In accordance with the invention, the support has a flattened shape and can have one application surface (and preferably two opposed, substantially parallel application surfaces) capable of coming into contact with one (or both) of the user's lips, the portion impregnated with the product being capable of being elastically deformed by compression of the surfaces by the lips, and of assuming their shape, so that a transfer of the product to the lips is effected during the compression of the support between the user's lips.

The term "pulverulent or pasty product" for lip care means any composition for treating the lips, in particular a make-up product which customarily has color pigments and a binder. Generally, this binder promotes the adhesion potential of the pigments to the lips and ensures the hold of the make-up in the course of time. When these pigments are mixed with a small quantity of the binder, a freely running make-up product is obtained. When a substantial quantity of the binder is mixed with the pigment, one obtains, depending on the nature of the binder, a product of a pasty, creamy or liquid consistency. The preferred product is a paste of lip rouge. However, the invention also encompasses the use of colorless care products for the lips such as protective products usable in the mountains during winter sports, for example a protective cream against ultraviolet radiation known as lip salve.

The product may be directly disposed on the support so as to constitute a single dose disposable make-up device and thus serve as a demonstration sample in beauty salons. In this case, the support charged with the product is advantageously protected by an appropriate protective cover. However, according to a preferred embodiment, the device of the invention is a multi-use device comprising a product reservoir into which the support dips in its rest position.

To facilitate the making up, the support may be mounted on a rigid element serving as a gripping handle. The fixing of the support on the rigid element may be effected by bonding, welding or by wedging of the support.

Generally, the support has a flattened shape with a thickness of approximately 0.4 cm to 2 cm and a width of approximately 4 cm to 8 cm. The general profile of the support may have a straight, concave, convex or any other shape allowing it to be tightly gripped between the lips to obtain a precise, aesthetic make-up without application to the adjoining portions of the face.

According to a first variant, the support has a slab made of an elastically compressible foam with open or closed cells.

According to another variant, the support is a hollow part made, for example, of a flexible elastomeric material.

In these two cases, the two surfaces of the support may be covered by a non-woven material promoting the taking up of the product.

Advantageously, the two surfaces of the support are covered by a flocking made, for example, of fine fibers of rayon®, cotton, nylon or polyester.

When the support is associated with a product reservoir, this reservoir is formed by a case having an opening for the insertion of the support, the support being in permanent contact with the product when it is inserted in the case.

To ensure a good spread of the product on the support, and to avoid any excess of the product, the case may have at least one wiper or compression lip capable of wiping the product or compacting it on the surfaces of the support as the support is being extracted from the case. This wiper or compacting lip may be made of a sponge or a foam.

According to a particular embodiment of the invention, the support may take the form of a flat flexible disk. In this case, the disk is mounted for rotation in the case, a portion of the support emerging from the case through an appropriate opening and serving to make up the lips, while a second portion of the support is in contact with the product contained in the case. Means may be provided for actuating the disk, allowing the disk to turn without bringing the user's fingers into contact with the product. By effecting a half-turn rotation of the disk, the portion of the disk which was previously in contact with the product in the reservoir emerges from the case and can serve for making up the lips. With this arrangement, one can ensure that the support is continuously impregnated with the product.

According to this embodiment, when the product is liquid, the edges of the opening of the case may have at least one wiper lip capable of wiping the product on the surfaces of the support during the rotation of the support. When the product is pulverulent, this lip may be a compacting lip allowing the powder to settle on the support.

When a make-up device has a reservoir, the support may generally be in direct contact with the product. However, especially when relatively liquid compositions are used, it may be advantageous to place into the reservoir at least one spongy element saturated with the product, this element being capable of coming into contact with the support. Permanent contact may be insured by adjusting the placement of the spongy element so that it touches the support. However it is possible to establish the contact between the support and the spongy element on a temporary basis. In this case, the case has at least one flexible side, deformable towards the inside of the case, the spongy element being fixed on the inner face of this flexible side. Deformation of the side of the case then produces the displacement of the spongy element and causes it to come into contact with the support, and thus the impregnation of the support by the product.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
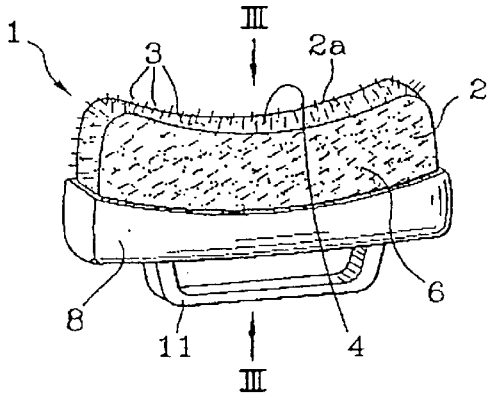
FIG. 1 is a view in elevation of a device for making up the lips in accordance with the invention, according to a first embodiment.
Figure 2:
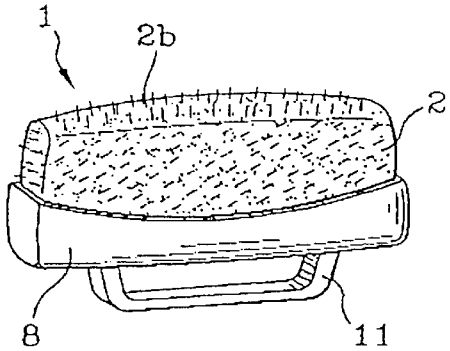
FIG. 2 is a view in elevation of a device for making up the lips in accordance with the invention, according to a second embodiment.
Figure 3:
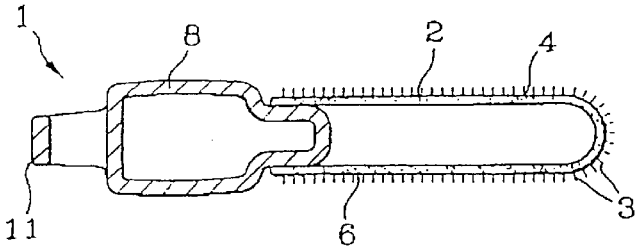
FIG. 3 is an axial section along plane III—III of FIG. 1.

Referring to FIGS. 1 to 3, there will be seen a device for making up the lips, which comprises a support 2 of an elongate flat shape. In FIG. 1, the support 2 has a profile 2*a* of a concave shape. In FIG. 2, the support 2 has a convex profile 2*b*. The supports 2*a* and 2*b* are made of a flexible elastically deformable material, for example an elastomeric material. As may be seen in FIG. 3, the support has a hollow interior. It has two opposed application surfaces 4, 6. The support 2 is covered with a covering 3 of fine fibers of rayon®, also called a flocking.

As a variant, it is also possible to make the support 2 of a spongy material, for example of a pad of cellular elastically compressible foam, with open or closed cells. This foam pad may also be provided with a flocking. As compared with average dimensions of the lips, the application surfaces 4, 6 of the support 2 are slightly overdimensioned.

The support 2 is fixed on a rigid base 8 having a gripping handle 11 on the opposite side to the support 2.

Figure 4:
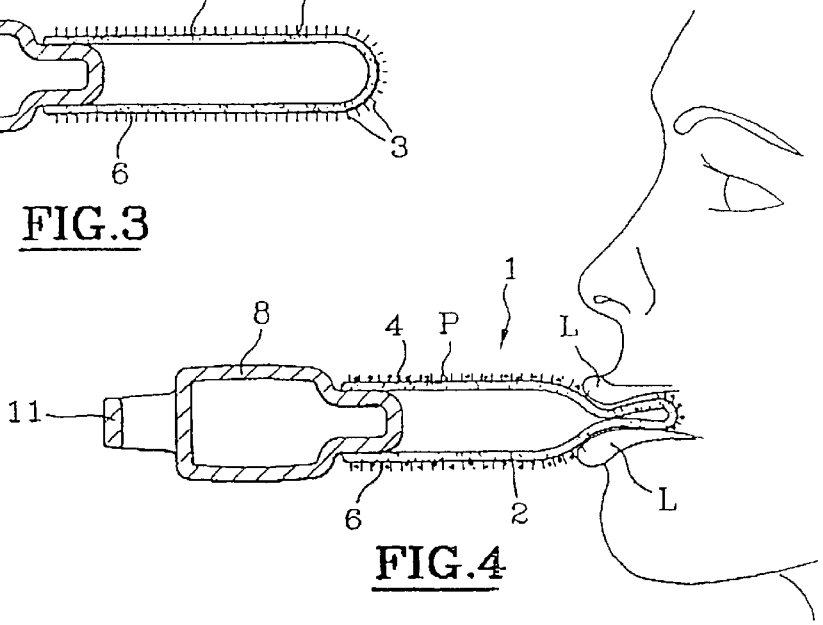
FIG. 4 shows the device of FIG. 3 in the course of making up a user's lips.

As may be seen in FIG. 4, the support 2 is charged with a product P. This product may be a pulverulent or liquid-to-pasty treatment composition. Preferably, the product P is a lip rouge cream. Due to the presence of the flocking 3, if this cream is relatively liquid, it will attach itself to the support without oozing out.

As shown in FIG. 4, in order to perform a make-up, the user simply grips the support 2 between both her lips. The support then elastically deforms and assumes the contour of the lips, and the transfer of the product P to the lips L is effected with precision over the whole surface of both lips in a single operation. Making up the lips is thus accomplished very quickly.

The support 2 may be precharged with the product P and constitute a single-dose applicator which is disposable after use. In this case, the support is covered by a protective cap (not shown).

Figure 5:
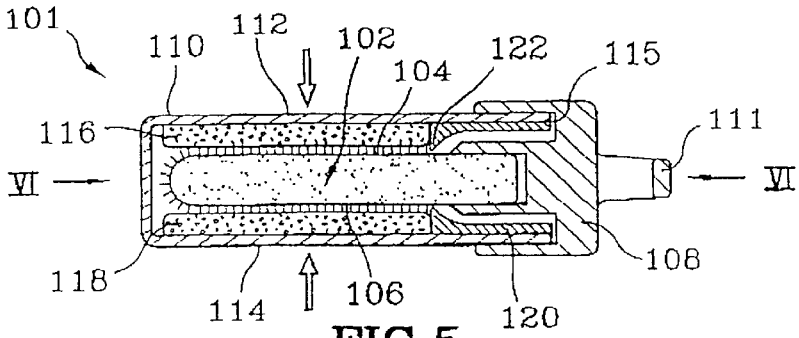
FIG. 5 is a longitudinal section of the make-up device of FIG. 3, including a product reservoir.
Figure 6:
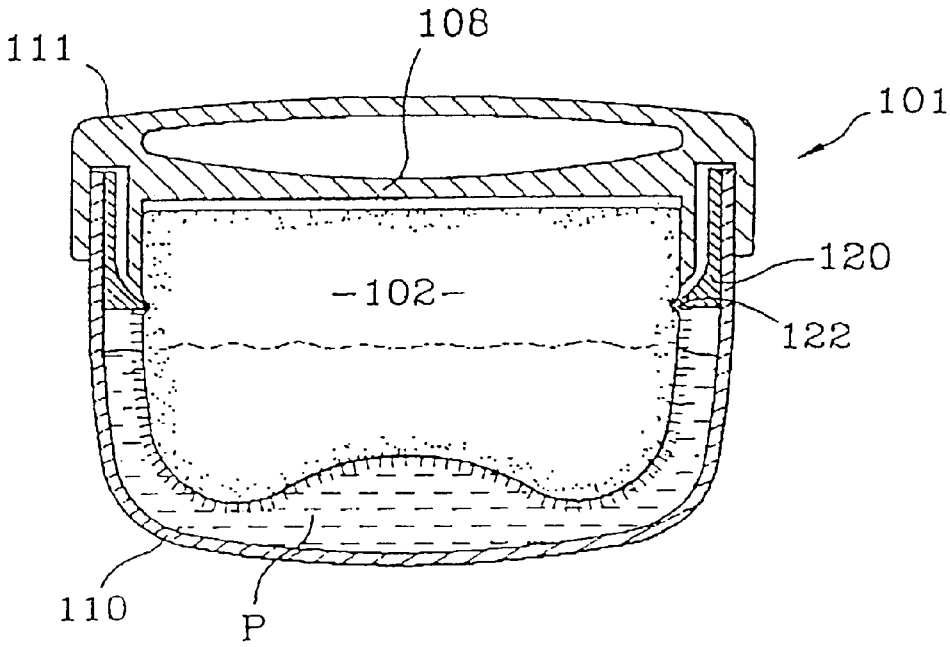
FIG. 6 shows an axial section along plane VI—VI of FIG. 5.

In FIGS. 5 and 6, a multi-use make-up device 101 is shown for a fluid product P. It has a support 102 made of an elastically deformable foam with open cells, joined to a rigid gripping handle 108 provided with a grip 111, this support being disposed in a leakproof manner in a case 110 with semi-rigid sides 112, 114. For this purpose the case is provided with an opening 115. The support 102 has two application surfaces 104, 106. Two sponge pads 116, 118 are placed between these surfaces 104, 106 and the walls 112, 114 of the case. These pads are saturated with a liquid make-up product or a lip care product. A wiper element 120 surrounding the support 102 is provided in the vicinity of the opening 115. The wiper element 120 has a wiper lip 122 in contact with the support 102, serving to spread the product homogeneously on the support and avoid any excess of the product. The wiper element 120 may be made of an elastomeric material or a cellular foam that is elastically deformable and can, if required, be provided with a flocking.

To make up her lips, the user compresses the sides 112, 114 of the case 110, to impregnate the support 102 with the product. She then proceeds with making up her lips in the same way as that described with reference to FIG. 4.

Figure 7:
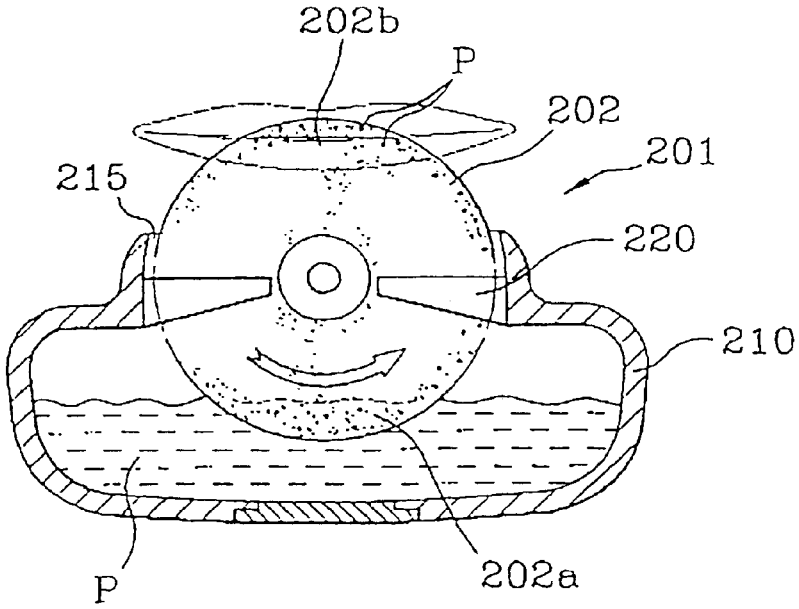
FIG. 7 shows an axial section of another embodiment of the invention having a product support mounted for rotation in a product reservoir.

FIG. 7 shows a case 210 forming a reservoir for a pulverulent or liquid product P. The case 210 is provided with a longitudinal opening 215 in which is mounted for rotation a disk-shaped support 202 made of an elastically deformable material. This disk is positioned so that a first portion 202*a* dips into the product P inside the case 210. A second portion 202*b* diametrically opposite the first is outside the case. When this disk is rotated through 180°, the portion 202*a* impregnated with the product is positioned on the outside and may serve for making up the lips as described above. The product P is spread homogeneously over the portion 202*a*, thanks to the presence of a lip 220 which wipes the product on the disk (when the product is liquid or pasty) or compacts the product on the disk (when the product is a freely running powder). This lip 220 may be made of an elastomeric material or of a cellular, elastically deformable foam.

Advantageously, the case used for the applicator in accordance with the invention has a mirror on one of its outer sides. Means may also be provided on the case, such as a small cord, for hanging up the case.

Obviously, numerous modifications and variations of the present invention are possible in light of the above teachings. It is therefore to be understood that the invention may be practiced otherwise than as specifically described herein.

What is claimed is:

1. A device for applying a material to a user's lips, said device comprising:

a material to be applied to a user's lips;

an elastically deformable support, wherein at least a portion of said support is impregnated by the material, the material being any one of a pulverulent material and a liquid-to-pasty material, said support having at least one application surface configured to come into contact with at least one of a user's lips, said at least one application surface being of a size and a shape so as to contact substantially an entire surface of the at least one user's lip at one time so that when said device is compressed between the user's lips, said at least one application surface is elastically deformed so as to assume a contour of the user's lips, said support being configured to transfer the material onto the at least one lip of a user when said device is compressed between the user's lips; and a reservoir for the material, wherein said reservoir is formed by said support.

2. A device for applying any one of a make-up product and a care product to lips of a user, said device comprising:

one of a make-up product and a care product to be applied to lips of a user; and a support, wherein at least a portion of said support forms at least one application surface holding any one of the make-up product and the care product in any one of a pulverulent form and liquid-to-pasty form such that when said device is positioned between lips of a user, said at least one application surface comes into contact with the lips of the user, said at least one application surface being elastically deformable in response to a compression generated by the lips of the user, wherein a deformability, a size, and a shape of said at least one application surface is such that, under said compression, the at least one application surface is deformed so as to assume the contour of the lips of the user, and to cause the product held by said surface to be transferred on substantially an entire surface of the lips of the user.

3. A device for applying a product to at least one of the user's lips, the device comprising:

a product to be applied to at least one of the user's lips; and a support comprising at least one portion formed of an elastically deformable material, said at least one portion of the support comprising at least one application surface and being configured to be loaded with the product, wherein the support has a size and shape permitting the support to be placed between spaced apart lips of a user, and wherein the support is configured such that when at least one of the user's spaced apart lips is moved toward the other lip to compress the support, said at least a portion of the support elastically deforms, said at least one application surface assumes a contour of at least one of the lips, and said at least a portion of the support transfers the loaded product to one of the lips contacting the at least one application surface.

4. The device of claim 3, wherein said at least one portion of the support is impregnated with the product.

5. The device of claim 4, wherein the support is configured to transfer the product to substantially the entire surface of said at least one of the lips.

6. The device of claim 4, wherein the product is a lip make-up product.

7. The device of claim 3, wherein the at least one application surface comprises two application faces.

8. The device of claim 7, wherein the two application faces comprise a first application face configured to contact one of the lips and a second application face configured to contact the other lip.

9. The device of claim 3, further comprising a gripping element associated with the support.

10. The device of claim 9, wherein the support is mounted on the gripping element.

11. The device of claim 3, wherein the at least one application face comprises flocking.

12. The device of claim 3, wherein said at least a portion of the support comprises elastically compressible foam material.

13. The device of claim 3, further comprising a reservoir and a mirror provided on the reservoir.

14. The device of claim 3, further comprising a reservoir, wherein the support is mounted to rotate with respect to the reservoir.

15. The device of claim 3, wherein the support has a disk-like configuration.

16. A device for applying a material to at least one of a user's lips, the device comprising:

a reservoir containing a material to be applied to a user's lips; and a support comprising at least one portion formed of a deformable material, said at least one portion of the support comprising at least one application surface and being configured to be loaded with the material, wherein the support has a size and shape permitting the support to be placed between spaced apart lips of a user, and wherein the support is configured such that when at least one of the user's spaced apart lips is moved toward the other lip to compress the support, said at least one portion of the support deforms and transfers the material to substantially the entire surface of at least one of the lips contacting said at least one application surface.

17. The device of claim 16, wherein the reservoir contains a material chosen from a lip make-up material and a lip care material.

18. The device of claim 17, wherein the material is chosen from a pulverulent material and a liquid-to-pasty material.

19. The device of claim 16, wherein the at least one portion of the support is configured to elastically deform upon compression of the support between the user's lips.

20. The device of claim 16, wherein the support is configured such that the transfer of the material to substantially the entire surface of the at least one lip occurs substantially without relative sliding movement between the support and the user's lips.

21. The device of claim 16, wherein the at least one application surface comprises two application faces.

22. The device of claim 21, wherein the two application faces comprise a first application face configured to contact one of the user's lips and a second application face configured to contact the other of the user's lip.

* * * * *